United States Patent [19]

Ogawa

[11] Patent Number: 4,666,378

[45] Date of Patent: May 19, 1987

[54] DIAPHRAGM TYPE PUMP DEVICE HAVING A CUSHION MEMBER

[75] Inventor: Hitoshi Ogawa, Himeji, Japan

[73] Assignee: Mitsubishi Denki Kabushiki Kaisha, Tokyo, Japan

[21] Appl. No.: 873,484

[22] Filed: Jun. 12, 1986

Related U.S. Application Data

[63] Continuation of Ser. No. 724,164, Apr. 17, 1985, abandoned.

[30] Foreign Application Priority Data

Apr. 25, 1984 [JP] Japan ..... 59-62788[U]

[51] Int. Cl.[4] ..... F04B 21/02; F01B 19/02

[52] U.S. Cl. ..... 417/571; 92/85 R; 92/100

[58] Field of Search ..... 417/571, 470, 471, 437; 92/85 R, 99, 98 R, 98 D, 100

[56] References Cited

U.S. PATENT DOCUMENTS

| | | | |
|---|---|---|---|
| 623,662 | 4/1899 | Goss | 92/85 R |
| 862,867 | 7/1886 | Eggleston | 417/390 |
| 2,515,110 | 7/1950 | Bornstein | 92/85 R X |
| 3,241,494 | 3/1966 | Johnson | 417/471 |
| 3,945,401 | 3/1976 | Greenwood | 137/627.5 |
| 3,969,045 | 7/1976 | Sakai et al. | 417/471 |
| 3,999,899 | 12/1976 | Sakai et al. | 417/471 |
| 4,050,861 | 9/1977 | Sakai et al. | 417/471 |
| 4,290,347 | 9/1981 | Basch | 417/471 X |

FOREIGN PATENT DOCUMENTS

| | | | |
|---|---|---|---|
| 51-40482 | 10/1976 | Japan | 417/568 |

*Primary Examiner*—Carlton R. Croyle
*Assistant Examiner*—Paul F. Neils
*Attorney, Agent, or Firm*—Oblon, Fisher, Spivak, McClelland & Maier

[57] ABSTRACT

A diaphragm type pump device has an elastic material imparting elasticity by the change of its volume which is placed in an operation chamber to decrease residual volume in the operation chamber when a diaphragm reaches the upper dead point.

4 Claims, 2 Drawing Figures

DIAPHRAGM TYPE PUMP DEVICE HAVING A CUSHION MEMBER

This application is a continuation of application Ser. No. 724,164, filed Apr. 17, 1985, and now abandoned.

BACKGROUND OF THE INVENTION

1. FIELD OF THE INVENTION

The present invention relates to an improved diaphragm type pump device to effect a pumping function by reciprocating movement of a diaphragm.

2. DESCRIPTION OF PRIOR ART

An air pump as an example of a diaphragm type pump device which has been generally known will be described with reference to FIG. 1.

In FIG. 1, an upper casing 2 provided with an intake port 4 and a discharge port 5 in the top surface is assembled with a lower casing 3 provided with an opening at the bottom surface to provide an inner space. A diaphragm 1 is held in the inner space with the outer circumferential part clamped by flanges of the upper and lower casings 2, 3, whereby an operation chamber (A) is formed in association with the upper casing 2 and the diaphragm 1. The operation chamber (A) is communicated with the outside through the intake port 4 in which a check valve 6 is arranged and the discharge port 5 in which a check valve 7 is arranged. The direction of communication of the check valve 6 is opposite to that of the valve 7. The diaphragm 1 is connected to a connecting rod 8 through reinforcing plates 9. The connecting rod 8 is driven by a driving source (not shown) in the direction indicated by arrow marks to effect reciprocating movement of the diaphragm 1.

In the diaphragm type pump device having the above-mentioned construction, when the connecting rod 8 is moved in the direction of a as shown by an arrow mark from the state as in FIG. 1, the diaphragm 1 is also moved in the direction of a. Accordingly, the volume of the operation chamber (A) is increased with the result of reduction in the pressure in the operation chamber, whereby the check valve 7 is closed, while the check valve 6 is opened to suck air through the intake port 4.

When the connecting rod 8 is moved in the direction of b to return to the state as shown in the FIG. 1, the diaphragm 1 is also moved in the direction of b. Accordingly, the volume of the operation chamber (A) is decreased and pressure in the operation chamber is increased, whereby the check valve 6 is closed, while the check valve 7 is opened to discharge air through the discharge port 5.

In the conventional pump device, however, the volume of the operation chamber (A) does not become zero even when the diaphragm 1 is at the upper dead point as shown in FIG. 1 in the reciprocating movement and there is a large amount of residual air in the operation chamber. Since the residual air is subjected to compression and expansion, change in pressure in the operation chamber is small in comparison with the distance of movement of the diaphragm 1. Therefore, efficiency of the pump device is low. Further, when the pump device is used for a compression pump or a vacuum pump, an achievable degree of vacuum is low.

To eliminate the disadvantage, there is an attempt of reducing a residual volume by changing the shape of the upper casing 2. However, when the residual volume is made too small, there is risk of damaging movable parts such as the diaphragm 1, the connecting rod 8 by impingement against the upper casing 2. Accordingly, reduction in the residual volume undegoes dimensional restriction.

SUMMARY OF THE INVENTION

It is an object of the present invention to eliminate the disadvantage of the conventional pump device and to provide a diaphragm type pump device having good pumping efficiency.

The present invention is to provide a diaphragm type pump device comprising a casing provided with an intake port and a discharge port, a diaphragm attached to the casing to constitute an operation chamber in association with the casing, a connecting rod having one end connected to the diaphragm to cause an amplitude movment of the diaphragm, first and second check valves respectively arranged in the intake port and the discharge port, the direction of communication of the first check valve being opposite to that of the second check valve, and material placed in the operation chamber to impart elasticity by the change of its volume so that a residual volume of the operation chamber is reduced, when the diaphragm is at the upper dead point and the volume of the operation chamber becomes minimum.

DETAILED DESCRIPTION OF PREFERRED EMBODIMENT

Figure 1:
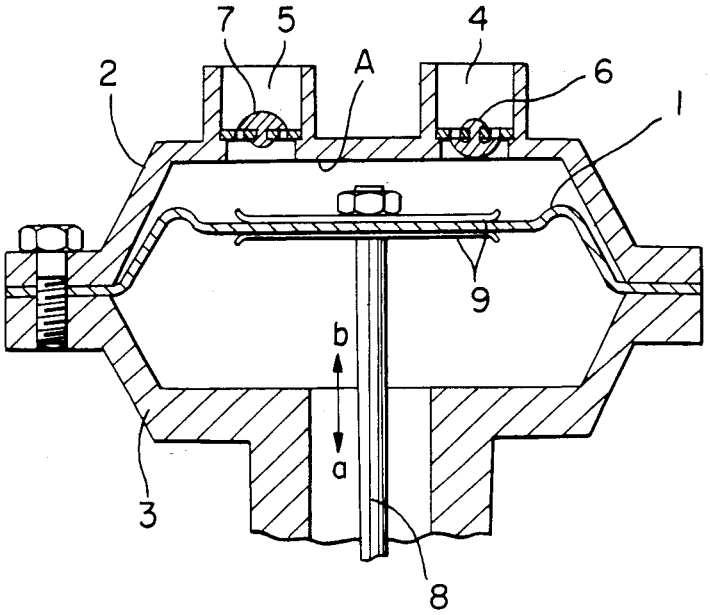
FIGURE 1 PRIOR ART
FIG. 1 is a cross-sectional view of a conventional diaphragm type pump device.
Figure 2:
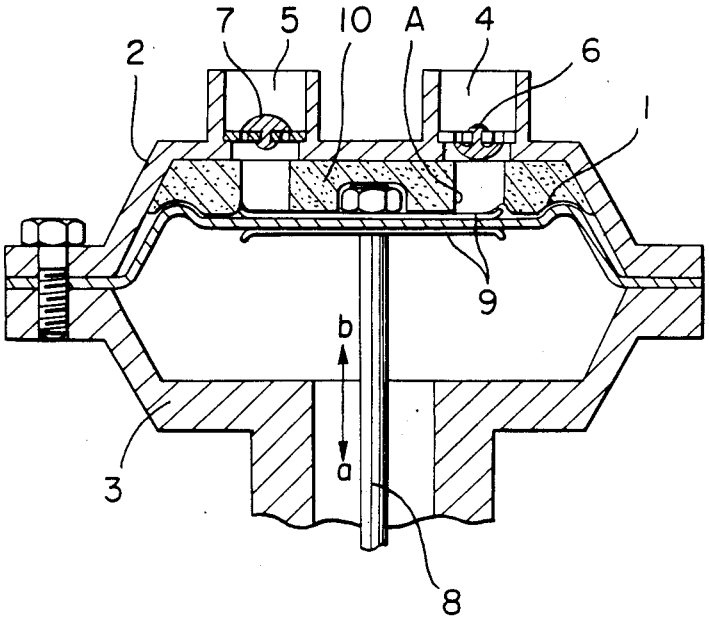
FIG. 2 is a cross-sectional view of an embodiment of the diaphragm type pump device according to the present invention.

An embodiment of the present invention will be described with reference to FIG. 2. The construction of the pump device of the present invention is substantially the same as that of the conventional pump device provided that a cushion member such as sponge having elasticity is attached to the inner wall of the upper casing 2 in the operation chamber (A). The cushion member is located so as not to interfere the stroke movement of the diaphragm 1. Description of the other parts is therefore omitted.

The sponge 10 has a substantial thickness to fill the operation chamber (A); the upper surface of the sponge is attached to the inner wall of the upper casing 2; the lower surface is shaped in accordance with the shape of the configuration of the upper surface of the diaphragm 1 and through holes are formed at positions corresponding to the intake port 4 and the discharge port 5.

In the pump device having the construction as above-mentioned, a residual volume in the operation chamber (A) when the diaphragm 1 is at the upper dead point (the state shown in FIG. 2), is extremely reduced by the volume of the sponge 10 and there remains only small amount of residual air in the operation chamber. Accordingly, adverse effect due to compression and expansion of the residual air is slight.

Since the sponge 10 imparts elasticity by the change of its volume, a large volume sufficient to occupy the operation chamber (A) is obtainable and shock caused when movable parts such as the connecting rod 8 and the diaphragm 1 impinge the upper casing 2, can be absorbed to thereby prevent breakdown of the movable parts.

In the foregoing, description has been made as to use of sponge as an elastic material or a cushion member for imparting elasticity by the change of its volume. It is, however, possible to use another elastic material such as rubber.

As described above, the pump device of the present invention is provided with material imparting elasticity by the change of the volume. Accordingly, a residual volume in the operation chamber can be reduced, whereby a residual amount of sucked air can be minimized and improve efficiency of a pumping function.

What is claimed is:

1. A diaphragm type pump device which comprises:

a casing provided with an intake port and a discharge port, a diaphragm attached to said casing and extending therein to an operation chamber defined by said diaphragm in association with an internal surface of said casing, a reciprocally driven connecting rod having one end connected to said diaphragm via a reinforcing plate to cause reciprocation of said diaphragm, first and second check valves respectively arranged in said intake port and said discharge port, the direction of communication of said first check valve being opposite to that of said second check valve, and an elastic cushion material placed in said operation chamber and secured to said internal surface of said casing, wherein a free surface of said elastic cushion material has a nonplanar shape corresponding to that of said diaphragm, said connecting rod and said reinforcing plate, and wherein said elastic cushion material has holes therethrough at positions corresponding to said intake and discharge ports, whereby a residual volume of said operation chamber is reduced when said diaphragm is at an upper dead point of said reciprocation and the volume of said operation chamber is at a minimum.

2. The pump device according to claim 1, wherein said elastic cushion material is constituted by a cushion member having a large number of independent pores.

3. The pump device according to claim 1, wherein said elastic cushion material is constituted by rubber.

4. The pump device according to claim 2, wherein said elastic cushion member is sponge.

* * * * *